United States Patent [19]

McCartney

[11] 4,342,805

[45] Aug. 3, 1982

[54] SIMULATED LEATHER SHEET MATERIAL

[75] Inventor: John McCartney, Chester County, Pa.

[73] Assignee: Norwood Industries, Inc., Malvern, Pa.

[21] Appl. No.: 188,330

[22] Filed: Sep. 18, 1980

[51] Int. Cl.[3] ..... B32B 5/06; B32B 5/22

[52] U.S. Cl. ..... 428/151; 427/372.2; 427/394; 427/444; 428/218; 428/288; 428/290; 428/904

[58] Field of Search ..... 428/212, 218, 300, 904, 428/151, 290, 288; 427/327.2, 394, 444

[56] References Cited

U.S. PATENT DOCUMENTS 3,708,333 1/1973 Carlson ..... 428/904
3,860,472 1/1975 Derville ..... 428/904
3,936,555 2/1976 Smith ..... 428/904
3,940,532 2/1976 Smith ..... 428/904

FOREIGN PATENT DOCUMENTS 54-21401 7/1979 Japan ..... 428/904

*Primary Examiner*—Paul J. Thibodeau
*Attorney, Agent, or Firm*—Webb, Burden, Robinson & Webb

[57] ABSTRACT

A simulated leather sheet material is comprised of a polymer impregnated fibrous mass with a grain layer forming one surface and a split layer forming the opposing surface. The grain layer has an actual density equal to its bulk density and the split layer has a bulk density less than its actual density. The sheet material has a density decreasing from the grain layer to the split layer.

11 Claims, 2 Drawing Figures

SIMULATED LEATHER SHEET MATERIAL

BACKGROUND OF THE INVENTION

1. Field of the Invention

This invention relates to simulated leather sheet material and to a method of preparing such simulated leather sheet material.

2. Description of the Prior Art

Natural leather, appropriately finished, is valued for its durability and aesthetic characteristics for a plurality of uses. Due to the scarcity of leather and the increased cost of processing leather for particular applications, economics have dictated that synthetic materials be substituted in certain applications where leather goods had been used. Such synthetic materials have been proposed and used in the areas of shoe uppers, upholstery, clothing, luggage making, book binding and similar applications. Because these various applications require differing physical, chemical, and aesthetic qualities, different processes using different materials must be used to obtain an acceptable product which is comparable to natural leather; although in most instances these synthetics are readily distinguishable from natural leather.

Natural leather from animal hides is composed of two surfaces: one surface defining the grain layer, which in most instances is the most aesthetically desirable and the opposing surface defining the split layer. The grain layer is the epidermis of the animal and is very smooth whereas the split layer in most instances is rough and fibrous.

One method of preparing a synthetic as a substitute for leather involves impregnating and/or coating of porous material, for example, cloth, with a polyurethane, vinyl or a similar material. Polyurethanes have met with wide acceptance as a coating or impregnating composition due to their capability of wide variation in chemical and physical properties particularly their flexibility and chemical resistance.

Objectives in preparing the synthetic substitutes for leather are that they provide: (1) sheets especially suitable for leather-like and upholstery uses; (2) sheets of uniform width as commonly used in the textile industry (unlike natural products which sustain substantial weight and area losses in cutting and finishing); (3) end use versatility, for example, under a variety of exposure conditions where certain chemical treatments will assist maintenance and useful lifetime of properties; and most importantly, (4) a product with the strength, hand, drape and softness comparable to natural leather.

Further, a simulated leather sheet material when used for shoe uppers should be characterized by a leather appearance, with no undesirable fabric show through, good water vapor permeation into the uncoated side of the upper, and a leather grain break (minimal gross wrinkling). "Leather-like grain break", as recognized in leather and upholstery industries, is manifested in the behavior of well finished leather when folded or crumpled. The leather fold is characterized by a smooth curved contour, frequently with numerous fine wrinkles in the compressed region of the fold area. This is contrasted with sharp creases or gross wrinkles formed when papers or films are folded; this kind of undesirable appearance is known as "pin wrinkling."

The "hand" of leather is highly distinctive and synthetics normally have a rubbery feel which is contrasted with leather.

Polyurethane polymers as coatings or impregnants for fabric to provide substitutes for leather have long been recognized. For example, polyurethanes can be made which are highly resistant to solvents and abrasion, conferring dry cleanability and outstanding durability to coated fabrics. The basic chemistry of polyurethanes, involving reactions between the isocyanate groups and molecules with multiply reactive hydrogen, such as polyols and polyamines, afford great versatility and variability in final chemical and physical properties by the selection of intermediates to achieve processibility and the desired balance of end use performance requirements.

There are various methods for applying polyurethane solutions or other post curable liquid polymers to porous substrates which are well known to those skilled in the art. An article in *Journal of Coated Fabrics,* Vol. 7 (July 1977), pages 43 through 57 describe some of the commercial coating systems, e.g. reverse roll coating, pan fed coater, gravure and the like. Brushing and spraying may also be used to coat polyurethanes on porous substrates. These polyurethane solutions, after impregnation or coating on the porous substrate, are dried or cured by a method such as heated air, infrared radiation and the like. Characteristic of these processes is the deposition of a polymer and a film like layer which tends to produce a coated fabric which folds in undesirable sharp creases rather than leather-like grain break. Other methods of combining polymeric solutions and particularly polyurethane solutions with porous substrates are exemplified by U.S. Pat. No. 3,208,875 and U.S. Pat. No. 3,100,721.

An improved process for impregnating fabrics is disclosed in U.S. Pat. No. 4,171,391 and an even further improvement is disclosed in U.S. Pat. application Ser. No. 188,329, filed the same day as this application, by John McCartney entitled "Impregnated Non-Woven Sheet Material" both the patent and patent application are incorporated herein by reference and made a part hereof. Both the cited application and cited patent include certain steps which are necessary in forming simulated leather sheet material in accordance with the invention.

In accordance with the present invention, a simulated leather sheet material is formed which has the appearance and properties of natural leather and further has certain physical similarities therewith.

BRIEF DESCRIPTION OF THE INVENTION

A simulated leather sheet material is comprised of a polymer impregnated fibrous mass with a grain layer forming one surface and a split layer forming the opposing surface. The grain layer has an actual density equal to its bulk density and the split layer has a bulk density less than its actual density. The sheet material has a density decreasing from the grain layer to the split layer.

DETAILED DESCRIPTION OF THE INVENTION

The fibrous mass useful in the practice of the invention include woven and knit fabrics, felt and non-wovens, such as spun bonded sheets, needled batts and waterleaves. Suitable substrate fibers are the natural fibers, particularly cotton and wool; synthetic fibers such as polyester, nylon, acrylics, modacrylics, and rayon. Most preferably, the fibrous mass is needled fibrous batts formed of such natural and synthetic fibers. Preferably, the fibers have a denier of 1 to 5 and a length which is suitable for carding which is typically one to six inches and more preferably one and one-half to three inches.

The needled fibrous batts can be either of high, intermediate or low density. The high density batts have a maximum density of 0.5 grams/cc. These high density batts are typically composed of wool. When synthetic fibers are used in forming the batts, the high density batts are up to 0.25 grams/cc. Preferably in the practice of the invention, the fibrous batts have a density of 0.08 grams/cc to 0.5 grams/cc. The thickness of the batts may be up to 0.5 inches and preferably between 0.12 inches and 0.4 inches with a minimum thickness of 0.030 inch. Additionally, the batts are characterized as "saturating batts" which have high integrity due to the needle punching operation as opposed to lightly bonded batts having few needle punches with little or no integrity.

The polymers which form the impregnant of the fibrous mass can be the well known synthetic polymers which in particulate form are capable of fusion with themselves under conditions of heat and pressure. Normally, these polymers are thermoplastic; however, some crosslinked polymers capable of coalescense may also be used. More particularly, polyurethanes described in U.S. Pat. application Ser. No. 947,544, filed Oct. 2, 1978 by Andrea Russiello entitled "Crosslinked Polyurethane Dispersions" have been found to be particularly useful in the practice of the invention to develop the desired density gradient through the thickness of the material.

The characterizing features of the simulated sheet material in accordance with the invention are primarily physical features wherein a density gradient is provided from one side of the sheet material to the opposing side of the sheet material. Preferably, the density gradient is uniform. One surface of the impregnated fibrous mass defines a grain layer with this grain layer having an actual density equal to its bulk density.

"Bulk density" as used herein means and refers to the density of the material including air space. "Actual density" as used herein means and refers to the density of the material not including air space, i.e. specific gravity.

This grain layer closely simulates the grain layer of natural leather. On the opposing side of the sheet material, there is a surface which defines the split layer which has a bulk density less than its actual density with there being a preferably uniform density gradient throughout the material. The split layer is somewhat fibrous and simulates the split layer of natural leather.

The polymer is present in the simulated leather sheet material at a level of at least 70% by weight add on based upon the weight of the fibrous mass.

Typically, the split layer is up to about 75% of the density of the grain layer to provide a porous grain layer simulating the grain layer of leather. Also it must be noted that the polymer is uniformly distributed throughout the fibrous mass in a manner wherein the ratio of fiber to polymer is uniform throughout.

The simulated leather sheet material is produced by processing an impregnated fibrous mass and preferably an impregnated non-woven sheet material prepared in accordance with U.S. Pat. application Ser. No. 188,329 of John McCartney entitled "Impregnated Non-Woven Sheet Material" and filed the same day as this application.

Most preferably, the polymer used as the impregnant is one of those or of the type disclosed in U.S. Pat. application Ser. No. 847,544 previously cited.

In one method of processing, the impregnated non-woven sheet material to form the simulated leather sheet, the impregnated non-woven sheet material is placed in a press and heat and pressure are applied to both sides thereof. The heat and pressure is sufficient to fuse the polymer to itself within the impregnant at the surfaces of the material, but yet insufficient to completely fuse the polymer at the interior of the sheet material. This process develops a density gradient from the interior of the non-woven sheet material to the two exterior surfaces. The dimensions of the gauge of the heated and pressed sheet material can be regulated by the pressure applied during the heating and pressing operations or by the insertion of spacers between the press plates or by use of a dead load press.

Further, the plates of the press can be embossed to provide a specific surface finish design to the material. After pressing, the sheet material is split down the middle to provide two simulated leather sheets each having a grain layer and a split layer.

In another process for forming the simulated leather sheet material, the impregnated non-woven starting material previously discussed can be placed in a press with only one of the plates heated to form the grain layer while having the opposing side on the cool plate forming the split layer.

In yet another process for forming the simulated leather sheet material, two pieces of the impregnated non-woven starting material previously discussed can be mounted upon each other in a press and heat and pressure applied sufficient to fuse the polymer to itself within the impregnant at the outer surface of each piece. After pressing the individual pieces are separated resulting in two sheets of simulated leather.

Subsequent to formation, the simulated leather may be buffed, coated or further processed in accordance with known leather finishing techniques.

In still another process, grain layer development may be accomplished on unwound strips of impregnated non-woven starting material unwound from packages and passed through a pair of rolls in a calendering operation. Preferably one of the rolls is metal, heated to 300° to 400° F., smooth or suitably embossed; and the other roll is a softer, resilient material, such as rubber. The grain layer will be developed on the metal roll side of the sheet. Effective calendering may be accomplished generally with a load of 5–15 tons/yard width of the sheet passing through the rolls. Wetting the sheet, prior to calendering, to 50 to 100 percent by weight added water may assist calendering.

The process of forming the simulated leather sheet material can be further understood by reference to the following example.

EXAMPLE I

A needled batt which was heat set and had a bulk density of 1,200 grams/meter$^2$ composed of polyester, polypropylene, and rayon fibers and a thickness of 0.3 inches with a bulk density of 0.16 grams/cm$^3$ was uniformly impregnated with 120% by weight add on based upon the weight of the batt with a polyurethane prepared in accordance with Example III of U.S. Pat.

application Ser. No. 947,544 of Andrea Russiello entitled "Crosslinked Polyurethane Dispersions", previously cited herein. The impregnated batt was formed in accordance with U.S. Pat. application Ser. No. 188,329 of John McCartney entitled "Impregnated Non-Woven Sheet Material", filed the same day as this application. Two 0.07 inch thick splits of the non-woven impregnated web were superposed upon each other and placed between plates of a press heated to 300° F. at a pressure of 500 psi for 30 seconds. The two splits were then peeled apart, thus obtaining two sheets of simulated leather sheet material. The grain layer of the sheets correspond to the surfaces which were in contact with the hot press plates. The interior sides of the sheets retained their fibrous texture similar to the unpressed sheet. Microscopic examination showed that the simulated leather sheet material had a density gradient from the grain layer to the split layer as is shown in FIG. 2.

The simulated leather sheet material, subsequent to formation can be post treated with other polymers for surface finishing in accordance with known techniques.

The structure of the simulated leather sheet material in accordance with the invention is illustrated by the following drawings which are photomicrographs of the material.

DETAILED DESCRIPTION OF THE DRAWINGS

Figure 1:
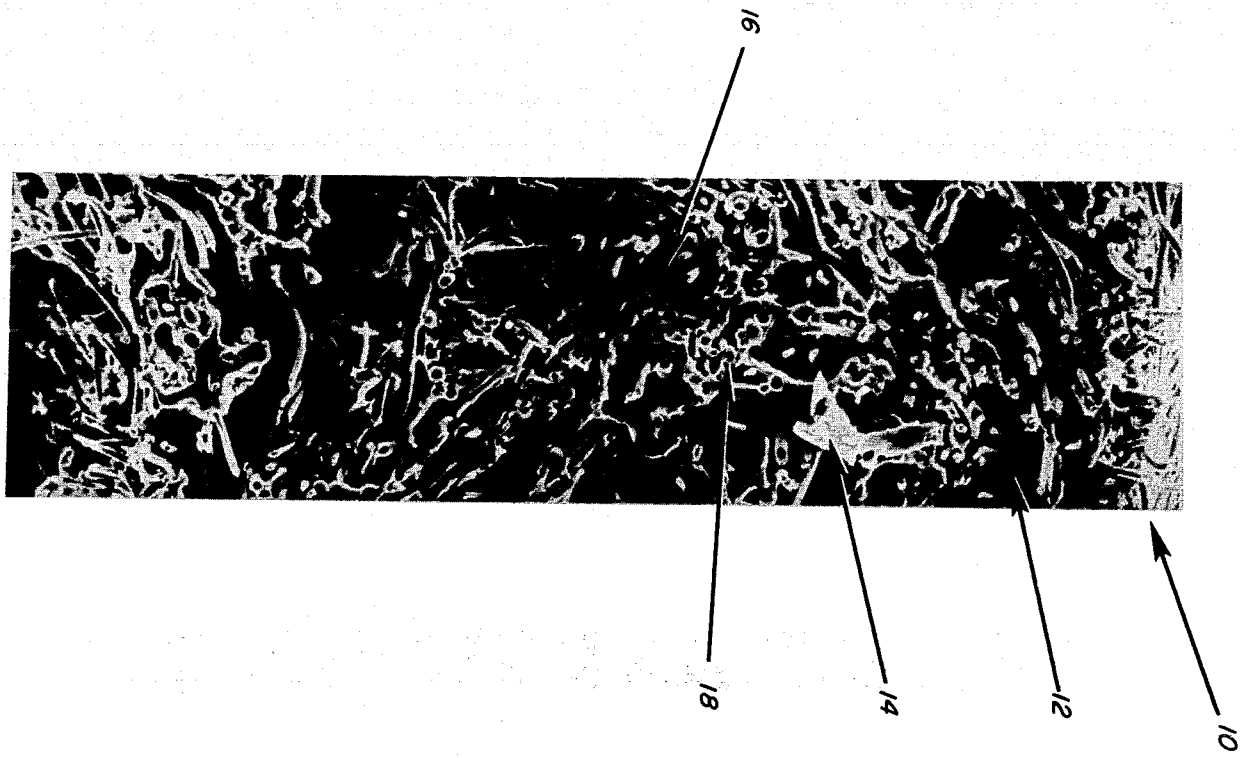
FIG. 1 is a photomicrograph of a cross-section through the thickness of a polymer impregnated non-woven needled batt magnified 100 times its actual size.

Referring now to FIG. 1 which is a 100× photomicrograph, there is shown an impregnated needled batt 10 having a uniform density throughout such as was used as the starting material in Example I. The impregnated batt 10 has a substantial amount of uncoated fibers 12, masses of polymer 14, coated fibers 18, and voids 16. It is to be noted that although the impregnated batt is non-homogeneous on a microscopic scale it has a uniform bulk density throughout.

Figure 2:
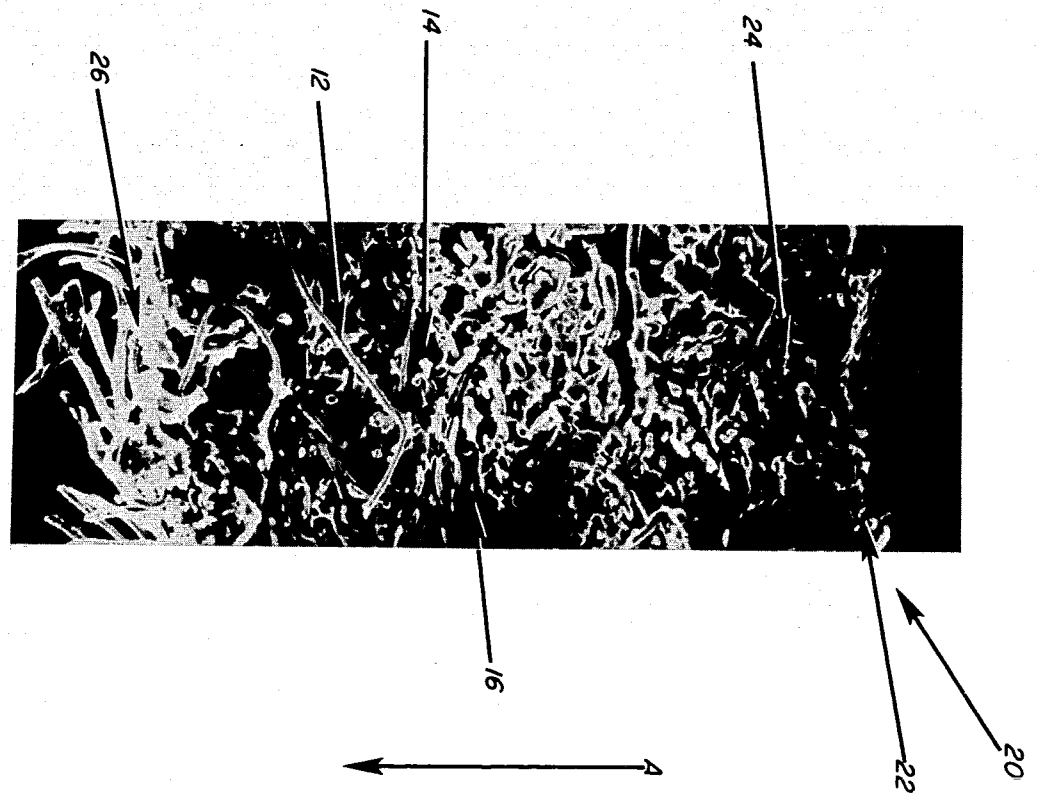
FIG. 2 is a photomicrograph of a cross-section through the thickness of a simulated leather sheet material in accordance with the invention produced from the impregnated non-woven batt of FIG. 1.

Referring now to FIG. 2 which is a 100× photomicrograph, there is shown the simulated leather sheet material 20 in accordance with Example I. The material 20 has a grain layer 22 which has minimal void space and the bulk density at the grain layer 22 is equal to the actual density. At the grain layer 22, there is formed a composite 24 of fibers in a continuous resin matrix as a result of the application of heat and pressure. Moving along the A direction, it is shown that the voids 16 increase along the direction approaching the split layer 26. At the split layer 26, there are a substantial number of voids 16, uncoated fibers 12, and masses of polymer 14. The structure at the split layer 26 approximates the structure shown in FIG. 1.

Thus in accordance with the invention, a simulated leather sheet material is provided which has properties closely approximating natural leather and having similar properties thereto.

Although the invention has been described with reference to particular materials and particular processes, the invention is only to be limited so far as is set forth in the accompanying claims.

I claim:

1. A simulated leather sheet material comprising:

a polymer impregnated fibrous mass with a grain layer forming one surface, the grain layer having an actual density equal to its bulk density and a split layer forming the opposing surface, the grain layer being a composite of fibers in a continuous resin matrix, the split layer having a bulk density less than its actual density, the split layer having coated and uncoated fibers, masses of polymer and voids, said sheet material having a density decreasing from the grain layer to the split layer, wherein the ratio of fiber to polymer is uniform throughout said sheet material.

2. The sheet material of claim 1 wherein the fibrous mass is a needled batt.

3. The sheet material of claim 1 wherein said polymer is a polyurethane.

4. The sheet material of claim 3 wherein said polyurethane is crosslinked.

5. The sheet material of claim 1 wherein said polymer is present at a level of at least 75% by weight add on based upon the weight of said fibrous mass.

6. The sheet material of claim 5 wherein said polymer is present at a level of up to 400% by weight based upon the weight of said fibrous mass.

7. The sheet material of claim 6 wherein said polymer is present at a level of 200 to 300% by weight add on based upon the weight of said fibrous mass.

8. The sheet material of claim 1 wherein the split layer is up to 75% of the density of the grain layer.

9. The sheet material of claim 1 wherein the density of said sheet material has a uniform gradient from the split side to the grain side.

10. A method of forming a simulated leather sheet material comprising:

uniformly impregnating a fibrous mass with a polymer to form a porous sheet material;

heating the porous sheet material under heat and pressure, said heat and pressure being applied to at least one surface thereof, to develop a simulated leather sheet material having a grain layer on the surface to which the heat has been applied, the grain layer having a bulk density equal to the actual density, said grain layer being a composite of fibers in a continuous resin matrix, a split layer having a bulk density less than its actual density, said split layer having coated and uncoated fibers, masses of polymer and voids, the sheet material having a density decreasing from the grain to layer to the split layer and wherein the ratio of fiber to polymer is uniform throughout said sheet material.

11. The method of claim 10 wherein heat and pressure is applied to both surfaces of said sheet material to develop a density gradient from the exterior of said sheet material to the interior of said sheet material and splitting the sheet material in half, the exterior surfaces forming the grain layer and the interior surfaces forming the split layers.

* * * * *